US009665064B1

(12) United States Patent
Kim

(10) Patent No.: US 9,665,064 B1
(45) Date of Patent: May 30, 2017

(54) OUTPUT APPARATUS WITH AN EXTERNAL TONER SUPPLYING DEVICE

(71) Applicant: GRS KOREA INC., Gyeonggi-do (KR)

(72) Inventor: Dong Jeung Kim, Gyeonggi-do (KR)

(73) Assignee: GRS KOREA INC., Osan-si, Gyeonggi-do (KR)

( * ) Notice: Subject to any disclaimer, the term of this patent is extended or adjusted under 35 U.S.C. 154(b) by 0 days.

(21) Appl. No.: 14/982,646

(22) Filed: Dec. 29, 2015

(51) Int. Cl.
*G03G 21/20* (2006.01)
*G03G 21/16* (2006.01)

(52) U.S. Cl.
CPC ..... *G03G 21/206* (2013.01); *G03G 21/1676* (2013.01)

(58) Field of Classification Search
CPC ..... G03G 21/206; G03G 21/1676; G03G 15/0874; G03G 15/0879; G03G 15/0865
See application file for complete search history.

(56) References Cited

U.S. PATENT DOCUMENTS 6,201,941 B1 * 3/2001 Kasahara ..... G03G 15/0822 399/106
8,814,319 B2 8/2014 Lebron et al.
2001/0041083 A1 * 11/2001 Terazawa ..... G03G 15/0855 399/258
2003/0053826 A1 * 3/2003 Bares ..... G03G 15/0822 399/258
2008/0219683 A1 * 9/2008 Muramatsu ..... G03G 15/0849 399/27
2012/0057890 A1 * 3/2012 Takuma ..... G03G 15/0879 399/53
2013/0314465 A1 11/2013 Lebron et al.

FOREIGN PATENT DOCUMENTS

KR 10-0892392 B1 4/2009
KR 10-2011-0092569 A 8/2011
KR 10-2014-0018889 A 2/2014
KR 10-2014-0080781 A 7/2014
KR 20-0474134 Y1 8/2014

OTHER PUBLICATIONS

International Search Report of PCT/KR2015/013843 mailed on Sep. 23, 2016.

* cited by examiner

*Primary Examiner* — Sandra Brase
(74) *Attorney, Agent, or Firm* — Rabin & Berdo, P.C.

(57) ABSTRACT

Disclosed is an output apparatus such as a printer or a copying machine, etc. equipped with an external toner supplying device, and the apparatus comprises a toner storage unit which does not require replacement inside an output main unit and a toner supply unit outside the output main unit in such a way that the output apparatus can continuously output by toner supplied from the external toner supply unit in case of using toner for the output of the main output apparatus.

16 Claims, 10 Drawing Sheets

OUTPUT APPARATUS WITH AN EXTERNAL TONER SUPPLYING DEVICE

BACKGROUND OF THE INVENTION

Field of the Invention

The present invention generally relates to an output apparatus such as a printer or a copying machine, etc. equipped with an external toner supplying device.

Description of the Related Art

Generally, a toner supplying device, i.e. a toner storage device is designed and used in a cartridge system allowing exchange and installment for a laser printer and a copying machine. Such a toner cartridge for a laser printer and a copying machine is installed inside machines, and internal space of the toner cartridge is designed small due to spatial constraints. Thus, it has caused a user of these laser printers and copying machines to often exchange toner cartridges inconveniently. In addition, their users had to pay a charge for the manufacturer's intellectual property right when exchanging a toner cartridge because the printer manufacture manufactures a toner cartridge with its own technology which is protected as intellectual property.

In order to solve such inconvenience and save the high expenses for maintenance, it has been suggested by recent technology that an uninterrupted toner supply device be installed outside a laser printer and a copying machine in such a way that toner is supplied by the external uninterrupted toner supply device as the toner is consumed.

An output apparatus using toner consists of complex components operating in reciprocal actions for efficient printing and the components can be categorized into semi-permanent goods and consumable goods. Consumable goods should be replaced in case they run down. Thus, such a characteristic has been considered in design for manufacturing a printer.

A toner cartridge as a toner storage device has been designed as a consumable component by the manufacturers of a laser printer and a copying machine. Some manufacturers have designed and produced their products in such a way that a mag roller or a developing roller is integrated with a toner cartridge, or even OPC drum is integrated. Thus, such components integrated with the toner cartridge are also replaced during toner cartridge replacement.

The system removed the inconvenience that consumable components should be replaced respectively according to their different lifespans.

However, the lifespan of major components such as an OPC drum or a roller has extended as semi-permanent with development of technology, and the method of replacing major components at once is not efficient any more.

SUMMARY OF THE INVENTION

Accordingly, the present invention is to improve the problems of the prior art. The present invention relates to providing an uninterrupted printing device allowing continuous print by installing a toner storage unit which doesn't require replacement for supplying toner to a toner cartridge instead of using a toner cartridge designed to be installed inside an output apparatus for replacement, installing a toner supply device for supplying toner to the toner storage unit of the output apparatus in case of running out of toner due to toner consumption by the output apparatus printing.

In order to accomplish this purpose, an output apparatus according to the present invention comprises an output main unit for printing on print media by a toner method; a toner storage unit installed in the output main unit for supplying a toner in case of printing; an external toner supply unit configured outside the output main unit for scattering toner by the air supplied and emitting toner by fluidity of air supplied; an air pump characterized by being a vacuum pump comprising of an air inlet and an air exhaust outlet; an air induction line connecting the air inlet of the air pump and a toner storage unit of the output main unit for air induction of the toner storage unit; an air supply line for transferring air caused by the air pump to an external toner supply unit; a toner supply line for the toner scattering unit scattering toner by the air supplied through the air supplied by the air supply line and transferring toner stored in a toner tank to the toner storage unit of the said output main unit by the fluidity of air; and a control unit for controlling operation of the air pump.

The said external toner supply unit comprises a toner tank for storing toner; a heater installed on one side of the outside of the toner tank or in a certain space inside the toner tank for preventing fixedness and corruption of toner by moisture absorption from the air in storing toner for a long time; and a toner scattering unit for receiving air supplied from the air supply line and transferring toner scattered by the fluidity of air to a toner supply line for scattering toner of a toner tank smoothly.

A toner scattering unit is satisfactory as long as it can transfer toner by the fluidity of air without flow resistance by scattering sufficiently toner, i.e. an ultrafine powder which can be easily compressed by applied pressure, and it can be carried out regardless of a shape or a size of inner or outer space of a toner tank.

A toner scattering unit can be installed inside or outside a toner tank by comprising an air supply pipe for receiving air and a toner exhaust pipe for discharging toner. In case of installment inside a toner tank, it can be assembled with a upper part of the toner tank to pass into the toner tank or can be assembled with a bottom part of the toner tank to pass into the toner tank.

In case of installing a toner scattering unit inside a toner tank, the apparatus further comprises a pressure control pipe installed additionally inside a toner tank, the pressure control pipe is a device to solve the problem that the air supplied to the toner scattering unit is moved to the top of toner and compressed and causes downward pressure to the toner in the lower layer. The device constitutes a structure to easily emit the air compressed in the air layer of a toner tank.

Preferably, a pressure control pipe has a connecting pipe structure; one end of a pressure control pipe is connected to an air layer of the upper part inside a toner tank, and the other end is connected to the vicinity of an air outlet of an air exhaust pipe.

A pressure control pipe can be installed inside a toner tank, or it can be installed outside a toner tank with one end of a pressure control pipe connected to an air layer by passing through one side of the upper part of the a toner tank and the other end connected to one side of a toner exhaust pipe in a toner scattering unit for the same effect as the pressure control pipe installed inside a toner tank.

In addition, instead of installing a pressure control pipe, the same effect can be carried out by installing a separation membrane; for dividing the inside of a toner tank into a toner layer and an air layer. The air supply line is branched and comprises a first air supply line connected to an air supply pipe of a toner layer; and a second air supply line connected to an air layer. Thus, this can be carried out as a method for preventing air from flowing from a toner layer to an air layer by causing the same pressure to a toner layer and an air layer.

In this case, a separation membrane can be configured horizontally to have a toner layer and an air layer divided up and down and it can consist of a toner bag made of a flexible material. In addition, an air bag which is expansible and contractible can be installed above an air layer for constant effect.

In case a toner scattering unit is installed outside a toner tank, a toner transfer feeder is installed for transferring toner in a toner tank to a toner scattering unit. Preferably, a toner transfer feeder is characterized by a fixed amount discharge unit. A fixed amount discharge unit comprises a transfer screw with a constant thread and a driving motor for operating the transfer screw, and a fixed amount of toner is transferred in proportion to the number of revolutions of the motor structurally. The air supply line comprises a first air supply line for supplying air to a toner scattering unit; and a second air supply unit connected to an air layer of a toner tank. The structure above causes a same air pressure in a toner tank and in a toner scattering unit so as to prevent air from flowing backward to a toner tank through a fixed amount discharge unit, i.e. a transfer failure due to increase of an air pressure in a toner scattering unit.

Thus, the present invention has the following advantages.

The output apparatus according to the present invention allows continuous output without requirement for replacement of a toner cartridge inside the output main unit by installing an external toner supplying device, removes inconvenience in replacement of a toner cartridge, and brings advantageous effects that environmental pollution by frequent replacement and disposal of a toner cartridge is prevented and expenses is saved for unnecessary replacement of a roller or OPC drum, etc. integrated with a toner cartridge.

In addition, even though remaining amount of toner in a toner tank is changed by consumption of toner and then the amount of air required for air pressure to transfer toner is changed, the output apparatus according to the present invention can scatter enough toner and easily transfer toner with a small amount of air.

In addition, the output apparatus according to the present invention is characterized by using a vacuum pump for an air pump supplying air needed to transfer toner. An induction air line is connected to a toner storage unit of the output apparatus for air supply. Pollution of toner due to using external air can be prevented and manufacturing expenses can be saved through a simple structure by solving the pressure increase problem occurring in a toner storage unit of the output apparatus during toner transfer.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
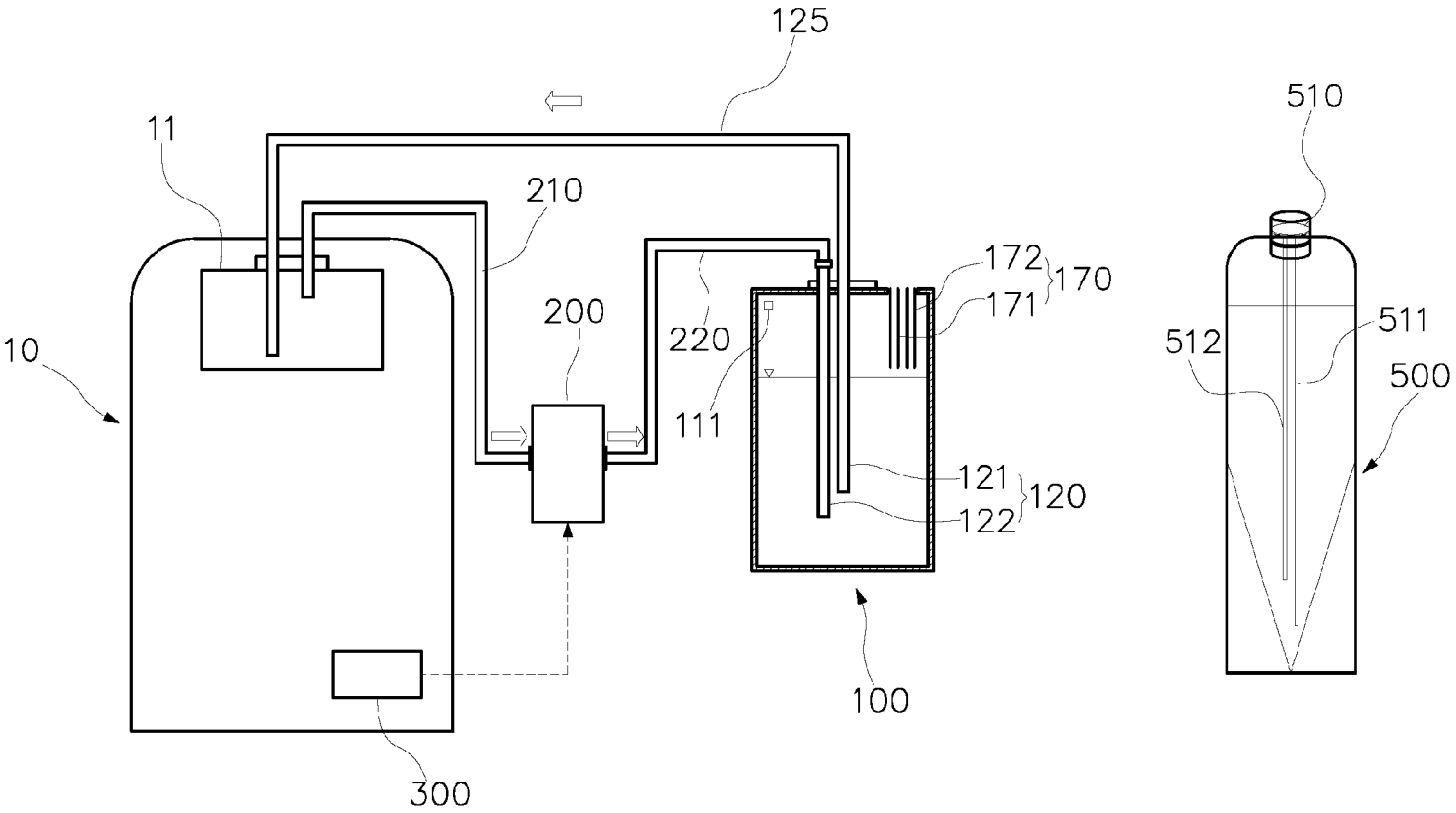
FIG. 1 is a diagram showing an overall scheme of an output apparatus according to the present invention.

Hereinbelow, exemplary embodiments of the present invention will be described in detail with reference to the accompanying drawings. Throughout the drawings, the same reference numerals will refer to the same or like parts.

Specific structures and functional explanations presented in exemplary embodiments of the present invention are merely exemplified to describe embodiments in accordance with the concept of the present invention. However, embodiments according to the present invention can be practiced in various ways. In addition, the present invention should not be construed as being limited only to the embodiments presented herein, and it should include all modifications, equivalents, and substitutes which are in the spirit and scope of the present invention.

Although in the present invention terms such as a first and/or a second etc. can be used to describe various components, however these components are not defined only by such terms. Such terms are merely used to distinguish one component from the other component. For example, a first component can be named for a second component and a second component can be named for a first component in the range without departing from the scope of the concept of the present invention.

In case it is stated that one component is "connected to" or "linked to" the other component, it should be construed that connection or link can be made directly to the other component and there can be another component in the middle. To the contrary, In case it is stated that one component is "directly connected to" the other component or "directly contacted with" the other component, it should be construed as nothing being in the middle. Other expressions for defining relation between components, i.e. "between~" and "right between~" or "adjacent to~" and "directly adjacent to~", etc. will be construed as above.

The terms used herein are merely used to describe specific embodiments, however, they are not meant to limit the present invention. Singular expression, if not obviously different by the context, will include a plural expression in meaning. Terms in the present invention such as "comprise" or "have" etc. are meant to designate embodied characteristics, numbers, steps, operations, components, parts, and combinations thereof as being present, but additional capability and existence of one or more other characteristics, number, steps, operations, components, parts, or combinations thereof are not precluded.

An output apparatus according to the present invention can include a laser printer, a copying machine, or an all-in-one machine for output by a toner output method. The apparatus is not restricted to a specific output means, and known configuration for output by a general toner method is omitted and the important configuration of the present invention is mainly explained. The present invention is described in detail with reference to the accompanying drawings hereinafter.

FIG. 1 is an overall scheme of an output apparatus according to the present invention.

In reference to FIG. 1, an output apparatus according to the present invention comprises an output main unit 10 equipped with a toner storage unit 11 for printing on print media by a toner method; a toner storage unit 11 installed in the output main unit 10 for supplying toner in case of printing; an external toner supply unit 100 configured outside an output main unit 10 for scattering toner by supplied air and discharging toner by fluidity of air; an air pump 200 characterized by being a vacuum pump comprising an inlet and an outlet; and a control unit 300 for controlling operation of the air pump.

An external toner supply unit 100 comprises a toner tank 110 for storing toner; a heater 111 installed on one side of the outside of the toner tank or inside the toner tank for preventing fixedness and corruption of toner caused by moisture absorption from the air; and a toner scattering unit 120 for receiving air supplied and scattering and discharging toner. A toner scattering unit 120 comprises an air supply pipe 122 for receiving air and a toner exhaust pipe 121 for discharging toner. In addition, one side of the upper part of the toner tank 110 comprises a storage link unit 170 comprising a toner induction pipe 172 and an air exhaust pipe 171 and toner is supplied in case toner runs out in a toner tank 110.

An air pump 200 comprises an air induction line 210 connected to a toner storage unit 11 for inducing the air in a toner storage unit 11; and an air supply line 220 for transferring the air caused by an air pump to a toner scattering unit 120 of an external toner supply unit 100.

A toner storage unit 11 corresponds to an output main unit 10 which is generally mounted on an output main unit 10, and printing on print media is carried with. For reference, a conventional toner cartridge is a consumable component and replaced in case toner runs out.

In the present invention, a toner storage unit 11 is installed inside an output main unit 11 and toner is supplied by an external toner supply unit 100. Thus, replacement of a toner cartridge is unnecessary.

In addition, a toner supply line 125 connected to a toner storage unit 11 is configured, and the toner supply line 125 is connected to a toner exhaust pipe 121 on a toner scattering unit 120 in such a way that toner is supplied to the toner storage unit 11. Thus, toner is temporarily stored in the toner storage unit 11 so as to be used in the output main unit 10 in case of printing.

In addition, the output apparatus according to the present invention comprises a toner container 500 of an air tight structure for storing and transferring toner and used for charging toner in case toner in a toner tank 110 runs out. One side of the upper part of toner container 500 comprises an air induction pipe 511; and a supply link unit 510 equipped with a toner discharge pipe 512. In case toner in the toner tank 110 runs out, the toner container is connected to a storage link unit 170 of the toner tank 110 in such a way that toner is transferred from a toner container 500 to a toner tank 110 by operation of the air pump without external air contact.

Although, in FIG. 1 a toner storage unit 11 is exemplified as a toner storage tank for storing toner and supplying toner while printing, a toner storage tank and a toner supply unit can be separately configured. A toner supply line 125 is exemplified as one pipe, but a plurality of pipes can be configured in connection. For example, a toner supply line 125 in an output main unit 10 according to the present invention can adopt a rigid pipe for self-assembly, and a toner supply line 125 outside an output main unit 10 can be configured by flexible hoses in connection.

Figure 2:
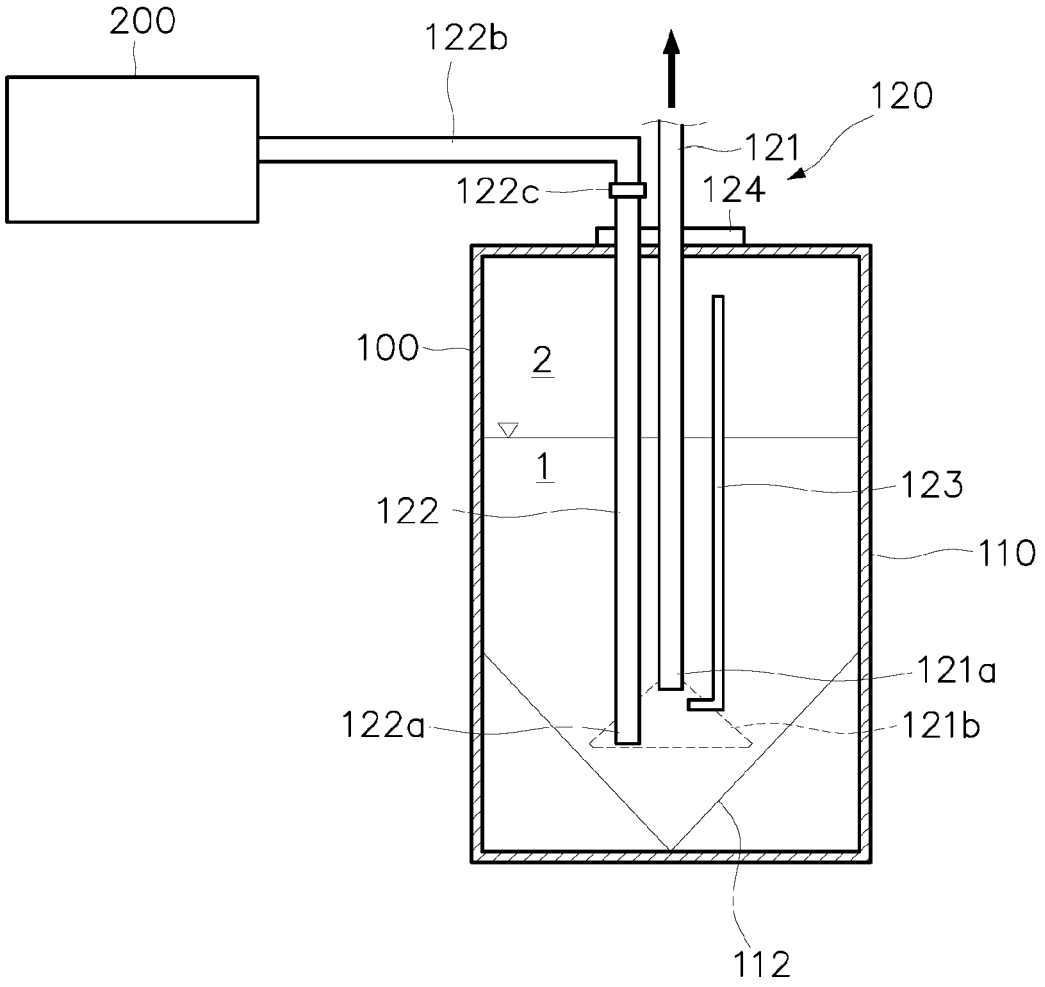
FIGS. 2-8 are diagrams showing other exemplary embodiments of an external toner supply unit according to the present invention.

FIG. 2 is a diagram showing another exemplary embodiment, i.e. a preferable exemplary embodiment, wherein a toner scattering unit 120 is installed through an opening part of the upper part of a toner tank 110. The same configuration as the aforementioned exemplary embodiment is depicted with the same reference numeral, and duplicate explanation is omitted.

In reference to FIG. 2, toner 1 in the lower part of a toner tank 110 is gathered in the center of a toner tank 110 because a tilt surface 112 is formed in an inverse conical shape in the lower part. Thus, waste of toner can be prevented therefrom.

A toner scattering unit 120 comprises a toner exhaust pipe 121 installed inside a toner tank 110 through an opening of the upper part of the toner tank 110 for discharging toner out of a toner tank 110; and an air supply pipe 122 connected to an air pump 200 and inserted in a toner tank 110 for supplying air into a toner tank 110 and further comprises a pressure control pipe 123 for relieving the air compression of the upper air layer 2 of toner 1.

A toner tank 110 stores toner in an airtight structure. Toner is discharged only through a toner exhaust pipe 121. Although not shown by a diagram, an openable stopper can be configured for charging toner in a toner tank.

A toner exhaust pipe 121 is inserted in a toner tank 110 in such a way that an exhaust inlet 121*a* of one tip of one side is submerged under toner 1, and one tip of the other side is connected to a toner supply line 125 so as to transfer toner.

Preferably, a cover member 121*b* can be configured by being extended and formed from an exhaust inlet 121*a* of a toner exhaust pipe 121. More preferably, such a cover member 121*b* is in a conical shape in order that the air discharged through an air outlet 122*a* in a lower part of an air supply pipe 122 is prevented from rising directly to the upper air layer 2 of toner 1 and scattered toner is gathered so as to be discharged to the outside.

An air supply pipe 122 is connected to an air pump 200, an air outlet 122*a* is configured lower than the height of an exhaust inlet 121*a* of a toner exhaust pipe 121. Thus, the compressed air caused by an air pump 200 can be emitted through an air outlet 122*a*.

This embodiment shows that an air supply pipe 122 is connected to an air pump 200 by a hose 122*b* or a connection member 122*c*.

Preferably, a toner exhaust pipe 121 and an air supply 122 can be fixed with an assembly module 124 and the assembly module 124 can be assembled with a toner tank 110. A toner exhaust pipe 121 and an air supply pipe 122 are assembled through an assembly module 124 so as to be configured in one body, and an assembly module 124 can be fixed by means of connection member such as a fastener or screw assembly with a toner tank 110.

The lower part of the pressure control pipe 123 of the toner scattering unit 120 is placed between an exhaust inlet 121*a* of a toner exhaust pipe 121 and an air outlet 122*a* of an air supply pipe 122, and the upper part is configured to be connected to the upper air layer 2 of toner 1.

The position of a pressure control pipe 123 can be fixed by an additional securing member (not shown in FIG.) placed in a toner tank 110.

An external toner supply unit 100 in this embodiment as configured above scatters toner by air supplied through an air supply pipe 122, discharges toner scattered by fluidity of air with air through a toner exhaust pipe 121 out of a toner tank 110. Meanwhile, a pressure control pipe 123 provides a structure in which an air layer 2 and an exhaust inlet 121*a* of a toner exhaust pipe are connected. Thereby, there is no pressure gap between an air layer 2 and an exhaust inlet 121*a* of a toner exhaust pipe 121. Thus, an exhaust failure caused by the pressure of the lower part of an air layer 2 can be prevented.

Figure 3:
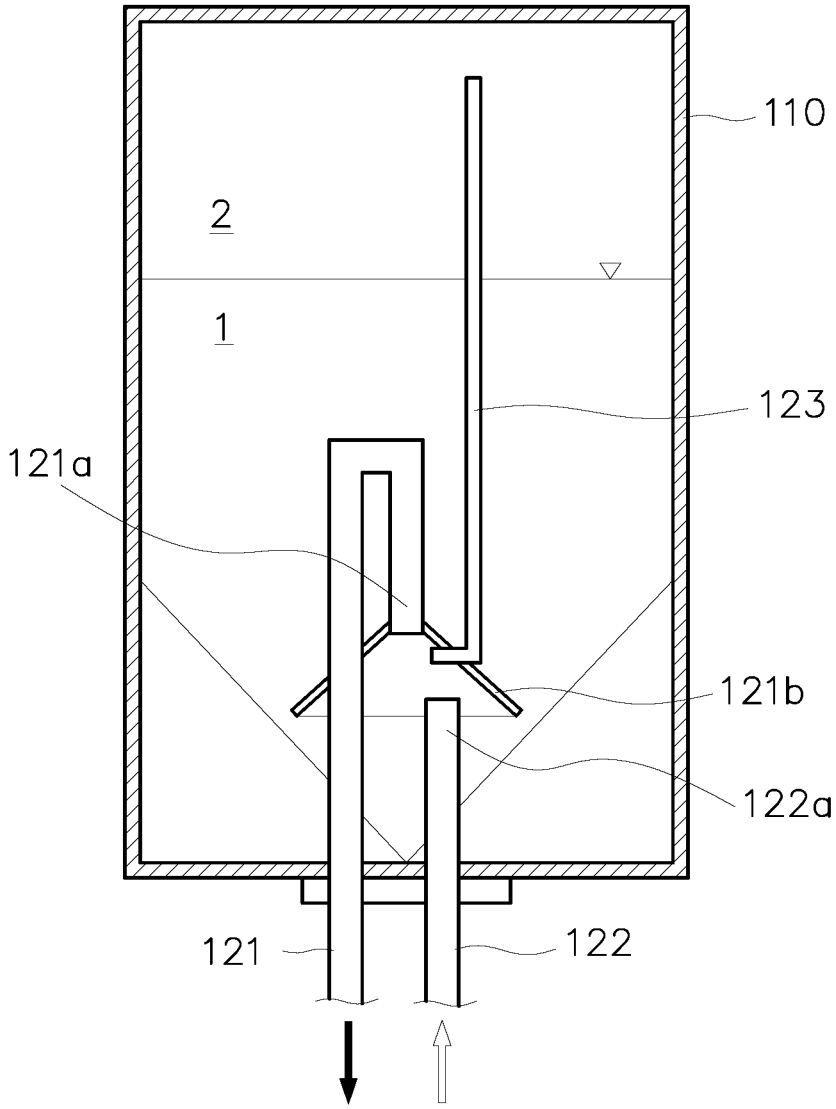

FIG. 3 is a diagram of a toner storage device according to another exemplary embodiment in which a toner scattering pipe and an air supply pipe are installed in the lower part of the toner tank.

In reference to FIG. 3, a toner exhaust pipe 121 is formed to be 180° bent in a toner tank 110 and is inserted into the lower part of a toner tank 110 by penetration, and a cover member 121*b* is configured above an exhaust inlet. In addition, an air supply pipe 122 is also inserted into the lower part of a toner tank 110 in such a way that the upper end of an air outlet 122*a* is placed lower than the upper part of an exhaust inlet 121*a* and the lower part of a pressure control pipe 123.

A toner scattering unit comprising a toner exhaust pipe a toner exhaust pipe and an air supply pipe as shown above is disposed in the lower part of the upper part of a toner tank by considering configuration and layout with an output apparatus in such a way that toner can be supplied. An exhaust inlet of an toner exhaust pipe and an air outlet of an air supply pipe can be disposed in various ways depending on a diameter or a length of a transfer hose and a pressure of an air pump.

Figure 4:
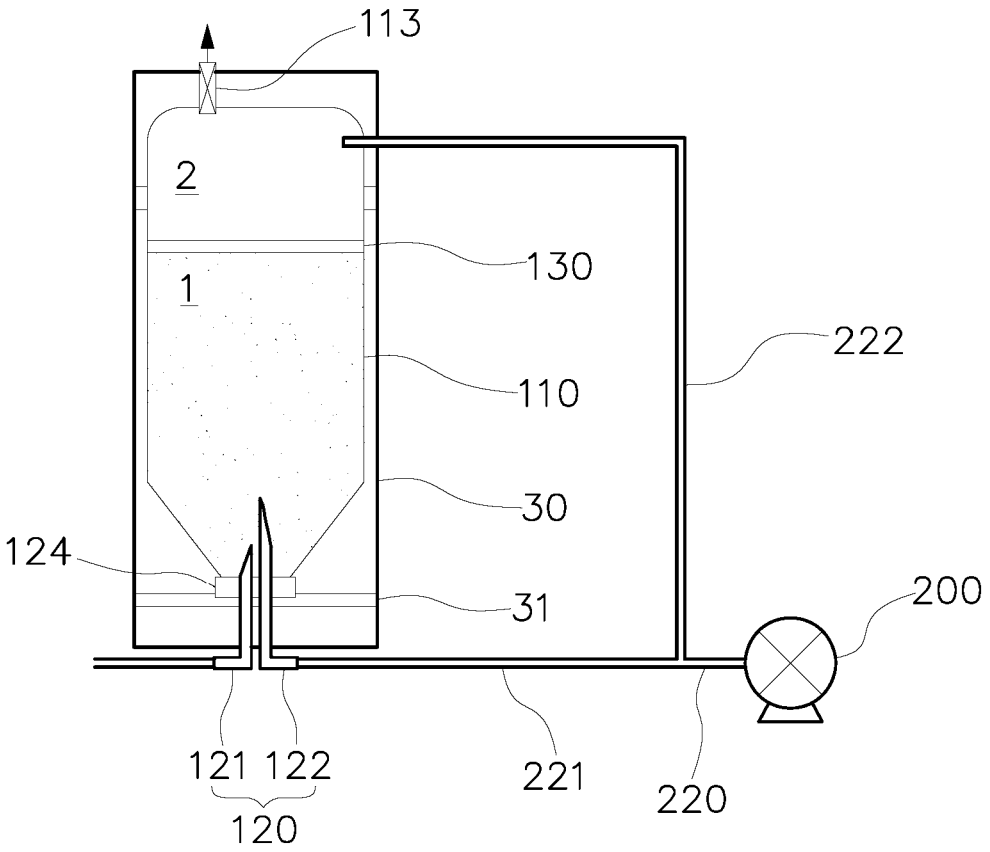
Figure 5:
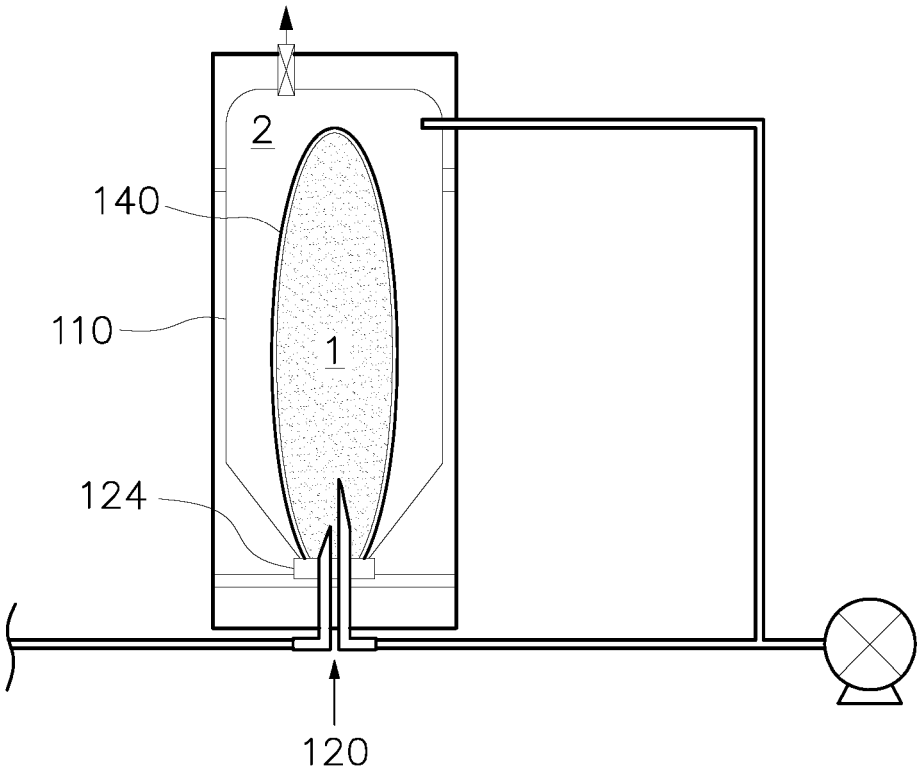
Figure 6:
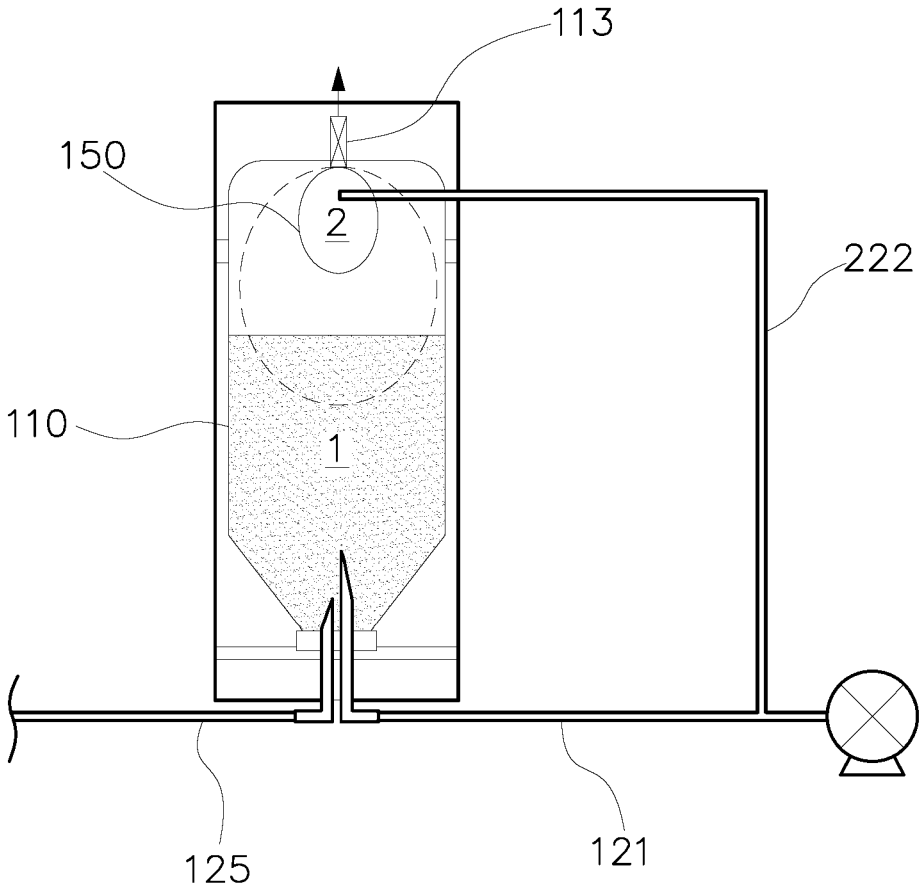

FIGS. 4-6 are diagrams showing other modified examples of an external toner supply unit. The same configuration as the aforementioned exemplary embodiment is depicted with the same reference numeral, and duplicate explanation is omitted.

In reference to FIG. 4, a toner scattering unit 120 equipped with a toner exhaust pipe 121 and an air supply pipe 122 is installed by assembly with an assembly module 124 through an opening in the lower part of a toner tank 110. A separation membrane 130 inside a toner tank 110 is configured horizontally so as to divide the space into an upper space and a lower space. Toner is stored in the lower space in which a toner layer 1 is formed while the upper space forms an air layer 2 separated from toner.

An air supply line 220 comprises a first air supply line 221 connected to a toner layer 1 of a toner tank 110, and a second air supply line 222 branched from a first air supply line 221 and connected to an air layer 2 of a toner tank 110. Thus, the air incurred by an air pump 200 is transferred to a toner layer 1 and an air layer 2 simultaneously.

The air incurred by an air pump 200 forms the same pressure respectively to a toner layer 1 and an air layer 2 divided by a separation membrane 130. However, the amount of air allocated to each layer is in proportion to a volume of air flow space. Thus, a request pressure for toner transfer can be built in a toner layer with the constant amount of air in regardless of the amount of toner consumed. For an air layer 2 of the upper space of a toner tank 110, in case the volume of an air layer 2 is increased due to the amount of toner consumed, the amount of air is increased proportionally.

Specifically, the amount of air needed to build a request pressure for toner transfer in a toner tank 110 is proportional to a volume of air flow space inside a toner tank. Thus, in case an air flow space of a toner tank is increased by toner consumption, the amount of air needed for a request pressure for toner transfer can be increased exponentially because air is compressed easily. Excessively injected air can freely move to a flow space and cause a scattering problem in a less sealed spot.

In order to improve this problem, the separation membrane 130 according to the present invention allocates a toner layer 1 and an air layer 2 in such a way that the air injected to an air layer 2 cannot be moved to other space so as to solve the aforementioned toner scattering problem.

Meanwhile, air compressed in an air layer 2 is discharged to a safe space by using a fuzzy valve 113 installed on the top of a toner tank 110.

In reference to FIG. 5, as another modified embodiment, a separation membrane for separating a toner layer 1 and an air layer 2 in a toner tank 110 can be a toner bag 140 made of a flexible material containing toner. An opening of the lower part of a toner bag 140 is configured with an assembly module 124 and a toner scattering unit 120 is installed by assembly. Air supply line is branched to be connected to a toner layer 1 and an air layer 2. Then, the same as those explained in aforementioned embodiment (See FIG. 4), air injected into a toner tank 110 is automatically allocated in proportion to an air flow space in a toner layer 1 and an air flow space in an air layer space 2. Thus, toner can be scattered with a small amount of air in regardless of change of an air layer 2 due to toner consumption.

In reference to FIG. 6, as another modified embodiment, a separation membrane for separating a toner layer 1 and an air layer 2 in a toner tank 110 can be an expansible air bag 150 connected to a second air supply line 222. In addition, an air bag 150 is connected to a fuzzy valve 113 so as to discharge the amount of air corresponding to the volume of the air bag, thereby, solving a problem which can be caused by an excessive air injection.

Figure 7:
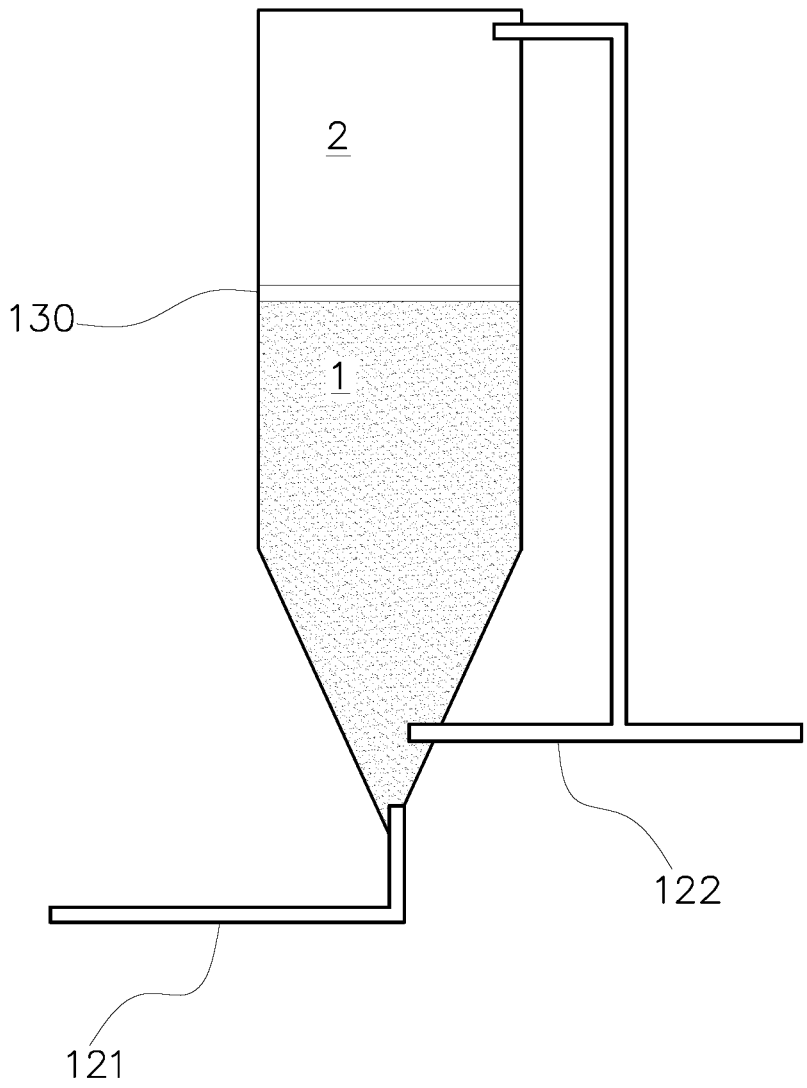

FIG. 7 is another embodiment, wherein the lower part of a toner tank 110 is configured as a toner exhaust pipe 121, an air supply pipe 122 is directly connected to the lower part of a toner layer 1 inside a toner tank structurally.

Figure 8:
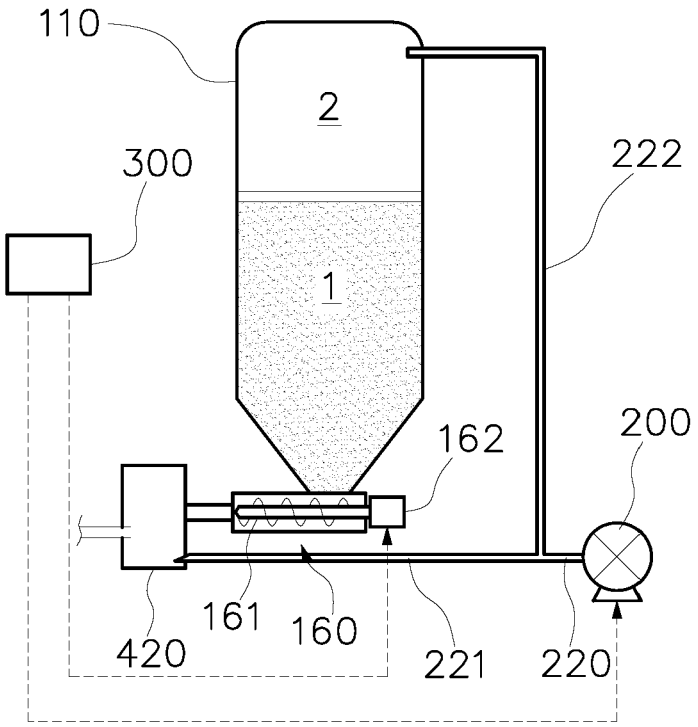

In reference to FIG. 8, a toner scattering unit 420 is installed outside a toner tank 110, and a toner feeder 160 is configured under a toner layer 1. A toner feeder 160 comprises a transfer screw 161 and a driving motor 162 for driving rotationally the transfer screw 161.

Preferably, a transfer screw 161 of a toner feeder 160 has a constant screw thread so as to discharge a constant amount of toner in proportion to the number of revolutions of the driving motor 162.

Although, a transfer screw 161 is configured horizontally in this embodiment, it can be configured vertically and toner can be transferred downwardly along the transfer screw rotatable along the vertical axis. At this time, the structure is not restricted to a specific design as long as a toner scattering unit 420 and a toner feeder 160 are connected in such a way that a constant amount of toner can be supplied by the structure.

A driving motor 162 is controlled in operation by a control unit 300. In case toner is needed to be charged, the control unit 300 operates an air pump 200 so as to supply air to a toner scattering unit 420 through an air supply line 220 and transfer toner through a toner supply line by a toner scattering unit 420 scattering the constant amount of toner supplied from a toner feeder 160.

Preferably, an air supply line 220 is branched to a first air supply line 221 for supplying air to a toner scattering unit 420 and a second air supply line 222 connected to an air layer 2 of a toner tank 110 so as to form the same pressure to a toner scattering unit 420 and an air layer 2 in operation of an air pump 200, thereby, preventing a transfer failure which can be caused by air flowing backward to a toner tank 110 in case the pressure in a toner scattering unit 420 is increased.

Figure 9:
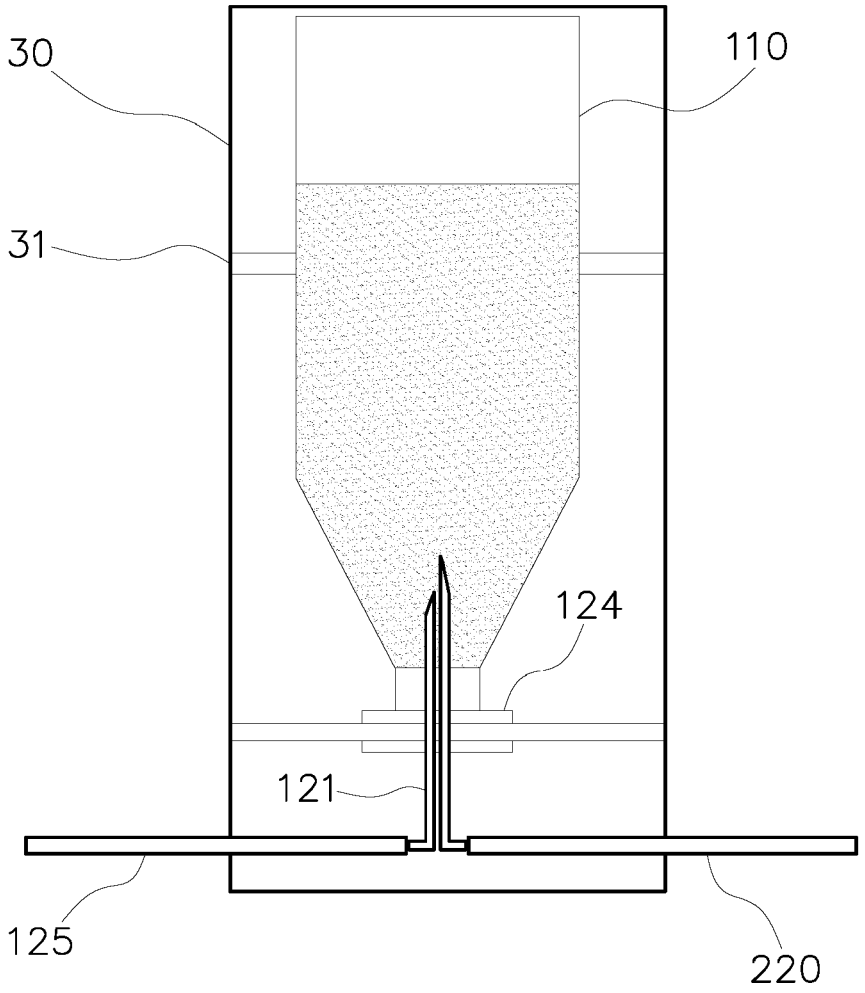
FIG. 9 is a diagram showing a housing structure of the external toner supply unit according to the present invention.

In reference to FIG. 9, a toner tank 110 from other embodiments can be accommodated in an additional housing 30, and it can be secured by a fixing bracket 31 configured to fix and support a toner tank 110 inside a housing 30.

In this embodiment, in case toner stored in a toner tank 110 runs down, a toner tank 110 is detached from a housing 30 for replacement so as to supply toner constantly to a toner storage unit 11.

Figure 10:
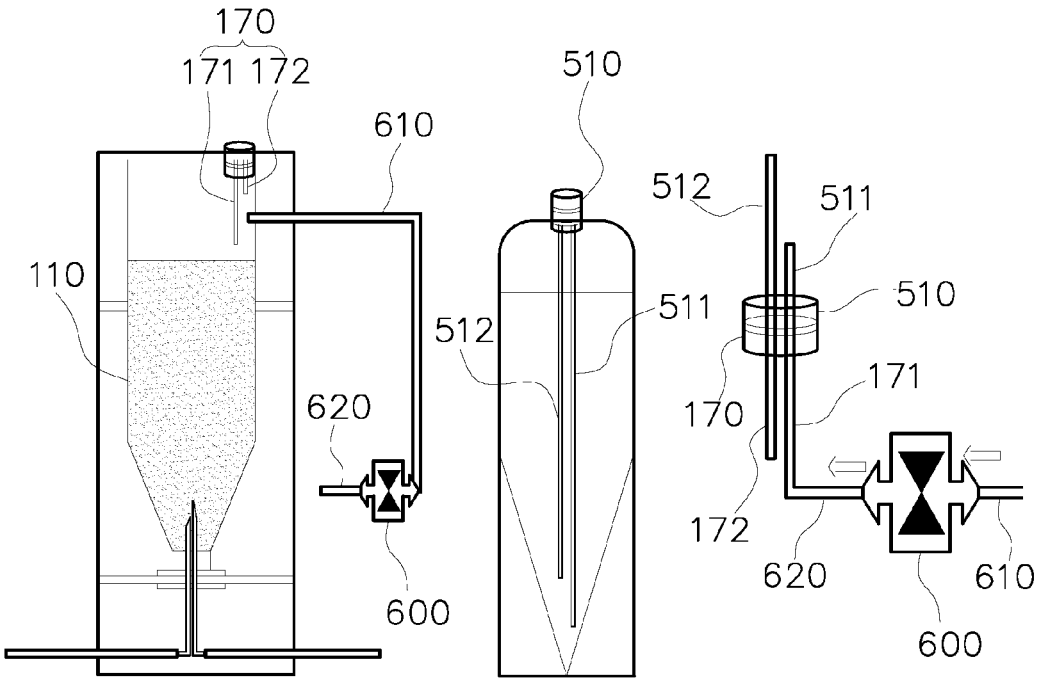
FIG. 10 is a diagram showing usages of an output apparatus according to the present invention.

In reference to FIG. 10, this embodiment comprises a toner tank 110; a toner container 500; and a second air pump 600. A storage link unit 170 is installed in the upper part of the toner tank 110, and a storage link unit 170 comprises an air exhaust pipe 171 and a toner induction pipe 172 in structure. An air exhaust pipe 171 is configured to be open in connection with an air inlet 610 of a second air pump 600, and a toner induction pipe 172 is configured to be sealed. In this embodiment, a storage link unit 170 is shown as being fixed in the upper part of a toner tank 110. However, it can be also movable from a toner tank 110 alternatively by configuration of an air exhaust unit 171 and a toner induction pipe 172 made of flexible hoses, etc.

An opening at the top of a toner container 500 is assembled with a supply link unit 510 in which an air induction pipe 511 and a toner exhaust pipe 512 are installed. In this embodiment, a supply link unit 510 is shown as being fixed to the one side of a toner container 500. However, it can be configured movable by configuration of an air induction pipe 511 and a toner exhaust pipe 512 made of flexible hose. In addition, although a second air pump 600 is installed separately from an air pump 200 shown in FIG. 1, it can be configured by using an air pump 200 in FIG. 1.

A supply link unit 510 and a storage link unit 170 can be connected and interlocked to each other in structure. For example, a supply link unit 510 and a storage link unit 170 can be assembled in a screw assembly method. By assembly of a supply link unit 510 and a storage link unit 170, an air induction pipe 511 of a supply unit 510 is connected to an air outlet 620 of a second air pump 600, and a toner discharge pipe 512 of a supply link unit 510 is connected to a toner induction pipe 172 of a storage link unit 170. Thus, in operation of a second air pump 600, a toner container 500 discharges toner by supplied air, and a toner tank is filled with discharged toner.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An output apparatus comprising:

a toner storage unit provided in an output main unit for printing on print media by a toner method;

an external toner supply unit provided outside the output main unit and comprising a toner tank for storing toner airtightly, and a toner scattering unit for scattering and transferring the toner from the toner tank;

a toner container for storing and transferring the toner airtightly, and supplying the toner without air contact to the toner tank;

an air pump characterized by a vacuum pump allowing simultaneous induction and discharge of air;

an air induction line connected to an inside of the toner storage unit and an air inlet of the air pump for inducing air from the toner storage unit;

an air supply line for transferring air caused by the air pump to the toner scattering unit of the external toner supply unit, the air supply line including a first air supply line connected to a toner layer of the toner tank, and a second air supply line branched from the first air supply line and connected to an air layer of the toner tank; and a control unit for controlling operation of the air pump.

2. The output apparatus according to claim 1, wherein the toner storage unit does not require replacement.

3. The output apparatus according to claim 1, wherein the toner scattering unit is equipped with an air induction pipe and a toner exhaust pipe.

4. The output apparatus according to claim 3, wherein the toner scattering unit is provided at a top portion of the toner tank, the air induction pipe is configured to supply the air from the air pump for scattering the toner inside the toner tank, and the toner exhaust pipe is configured to discharge the toner therethrough.

5. The output apparatus according to claim 4, wherein the toner tank further comprises a pressure control pipe connecting the air layer and a lower part of a toner outlet.

6. The output apparatus according to claim 3, wherein the toner scattering unit is provided at a bottom portion of the toner tank, the air induction pipe is configured to supply the air from the air pump for scattering the toner inside the toner tank, and the toner exhaust pipe is configured to discharge the toner therethrough.

7. The output apparatus according to claim 6, wherein the toner tank further comprises a pressure control pipe connecting the air layer and a lower part of a toner outlet.

8. The output apparatus according to claim 1, wherein the toner tank further comprises a separation membrane for dividing an inside of the toner tank into the toner layer and the air layer.

9. The output apparatus according to claim 8, wherein the separation membrane is a toner bag made of a flexible material.

10. The output apparatus according to claim 8, wherein the separation membrane is an air bag expansible by connection with the second air supply line.

11. The output apparatus according to claim 1, wherein the toner scattering unit is installed outside the toner tank.

12. The output apparatus according to claim 1, wherein the toner tank further comprises a toner feeder for supplying the toner to the toner storage unit by connecting to the toner scattering unit.

13. The output apparatus according to claim 12, wherein the toner feeder comprises a transfer screw with a constant thread; and a driving motor for operating the transfer screw, wherein a constant amount of toner is supplied in proportion to a number of revolutions of the driving motor.

14. The output apparatus according to claim 1, wherein the toner tank further comprises a storage link unit, wherein the storage link unit is equipped with an air outlet and a toner induction pipe.

15. The output apparatus according to claim 14, wherein the toner container includes a supply link unit for discharging the toner by air supply, wherein the supply link unit is equipped with a toner exhaust pipe and an air induction pipe.

16. The output apparatus according to claim 15, wherein the supply link unit and the storage link unit are configured to be coupled with each other such a way that the air induction pipe of the supply link unit is connected to the air outlet of the storage link unit, and the toner exhaust pipe of the supply link unit is connected to the toner induction pipe of the storage link unit, whereby the toner of the toner container is transferred to the toner tank in operation of the air pump.

* * * * *